US005087496A

United States Patent [19]

Bouchoucha

[11] Patent Number: 5,087,496

[45] Date of Patent: Feb. 11, 1992

[54] SELF-ADHESIVE NYLON STOCKING PATCH

[76] Inventor: Michel Bouchoucha, 1431 Ocean Ave., No. 810, Santa Monica, Calif. 90401

[21] Appl. No.: 655,800

[22] Filed: Feb. 14, 1991

[51] Int. Cl.[5] ..... A41B 11/00; B32B 3/06

[52] U.S. Cl. ..... 428/63; 156/94; 428/100

[58] Field of Search ..... 428/63, 100; 2/239, 2/DIG. 6; 206/582; 156/94

[56] References Cited

U.S. PATENT DOCUMENTS

| | | | |
|---|---|---|---|
| 3,196,638 | 7/1965 | Marley | 66/1 R |
| 3,423,764 | 1/1969 | Cassling | 428/100 X |
| 3,834,185 | 9/1974 | Davenport | 66/1 R |
| 4,058,853 | 11/1977 | Boxer et al. | 428/100 X |
| 4,165,555 | 8/1979 | Boxer et al. | 428/100 X |
| 4,176,001 | 11/1979 | Bringman et al. | 156/581 |
| 4,324,603 | 4/1982 | Crandall et al. | 428/63 X |
| 4,994,127 | 2/1991 | Sallenbach | 428/63 X |

*Primary Examiner*—Henry F. Epstein

[57] ABSTRACT

A self-adhesive stocking patch for mending a nylon stocking. In its broadest aspects, the stocking patch comprises a thin resilient element of a shape and size to approximate typical tears occurring in nylon stockings. Adhesive attachment means is affixed to the element for securely attaching the element to portions of the nylon stocking adjacent to such a tear. The adhesive attachment means includes at least one piece of synthetic material of the type that adheres when pressed together with nylon (i.e. VELCRO TM). When applied to the stocking the patch provides an expedient means for temporary repair.

3 Claims, 3 Drawing Sheets

SELF-ADHESIVE NYLON STOCKING PATCH

BACKGROUND OF THE INVENTION

1. Field of the Invention

The present invention relates generally to mending stockings and more particularly to a convenient polyamide patch for repairing nylon stockings.

2. Description of the Related Art

There has been a long-felt need for repairing nylon stockings in a fast, easy and convenient manner. Previously, holes, runs and the like in ladies stockings have been repaired by means, for example sewing, which leaves an unsightly repair. Runs are often repaired by applying a cement, such as clear fingernail polish or the like, to the run.

Other more extravagant methods have been developed which attempt to provide more effective repairs. For example, U.S. Pat. No. 4,324,603, entitled HOSIERY REPAIR KIT, discloses a kit that includes a repair strip, textured as original hosiery material, adhesive-backed and carried in strips or a tape on a peel-off backing. The backing may be in the form of a sheet carrying several strips. As a tape, the repair material may be mounted in a dispenser which has a cutting mechanism and a take-up reel for the waste backing material.

Other relatively complex mending machines include those disclosed in U.S. Pat. No. 4,176,001, entitled STOCKING MENDING APPARATUS, U.S. Pat. No. 3,834,185, entitled APPARATUS AND METHOD FOR MENDING KNIT FABRIC, and U.S. Pat. No. 3,196,638, entitled REVERSIBLE ROTARY HOSIERY MENDING APPARATUS.

All of the above-mentioned devices are somewhat bulky, relatively expensive, and vulnerable to breaking down during use.

OBJECTS AND SUMMARY OF THE INVENTION

It is a principle object of the present invention, therefore, to temporarily repair, hide, and prevent growth of a tear or loose strand in a nylon stocking in a quick and inexpensive manner.

Another object is to repair runs in nylon stockings in an easily accessible manner.

Yet another object is to provide the wearer with a decorative new look and fashionable nylon patch.

These and other objects are achieved by the present invention which is a self-adhesive stocking patch for mending a nylon stocking. In its broadest aspects, the stocking patch comprises a thin resilient element of a shape and size to approximate typical tears occurring in nylon stockings. Adhesive attachment means is affixed to the element for securely attaching the element to portions of the nylon stocking adjacent to such a tear. The adhesive attachment means includes at least one piece of synthetic material of a type that adheres when pressed together with nylon, (i.e. VELCRO TM). When applied to the stocking, the patch provides an expedient means for temporary repair.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the FIGURES of the drawings are designated by the same reference characters.

DETAILED DESCRIPTION OF THE PREFERRED EMBODIMENTS

Figure 1:
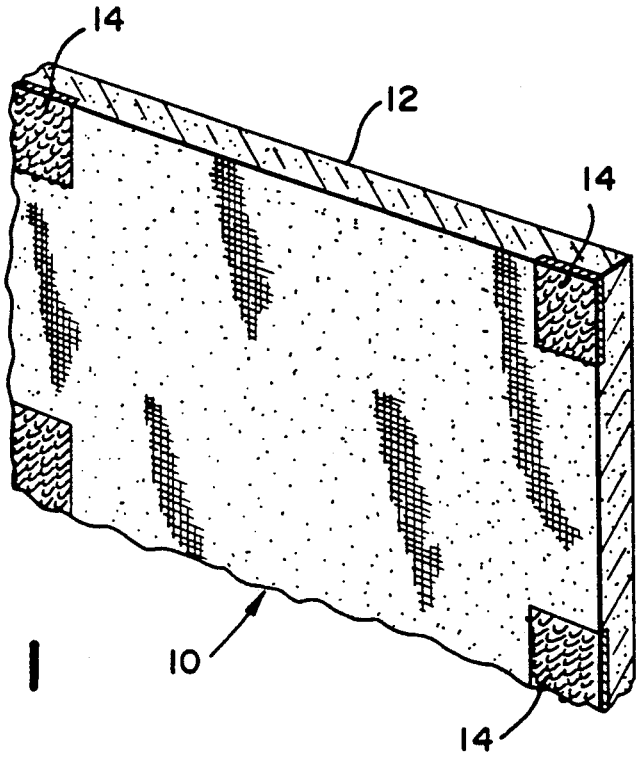
FIG. 1 is a perspective view of a portion of the nylon stocking patch of the present invention.

Referring to the drawings and the characters of reference marked thereon, FIG. 1 illustrates a portion of the nylon stocking patch of the present invention, designated generally as 10. Stocking patch 10 includes a thin resilient element 12, preferably formed of polyamide. Adhesive attachment means 14 are affixed to the element 12. Each adhesive attachment means 14 comprises synthetic material of the type that includes numerous slender, hooked filaments that adhere when pressed together with a complementary mating fabric (commonly sold under the trademark "VELCRO"). Applicant has noted that use of VELCRO TM is particularly effective in attaching to nylon stockings, providing an easy and secure attachment. It is especially effective because the VELCRO TM attachment fibers are able to catch the undamaged portion(s) of the stocking adjacent the run. Other attachment means, such as glue based adhesive strips do not prevent increased running of the stocking in such a manner.

Figure 2:
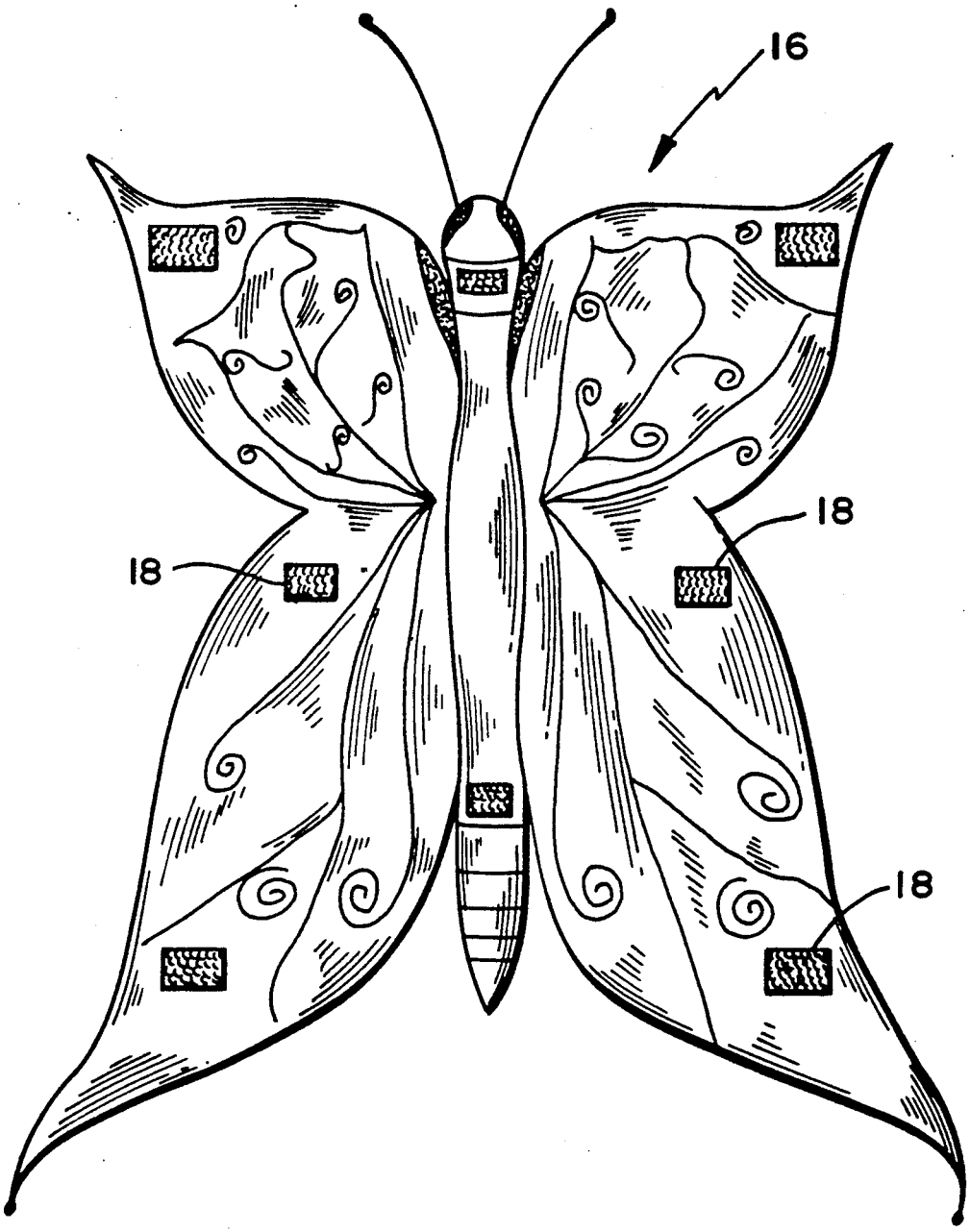
FIG. 2 is a bottom plan view of a nylon stocking patch embodying the principles of the present invention and shaped to the appearance of a butterfly.
Figure 3:
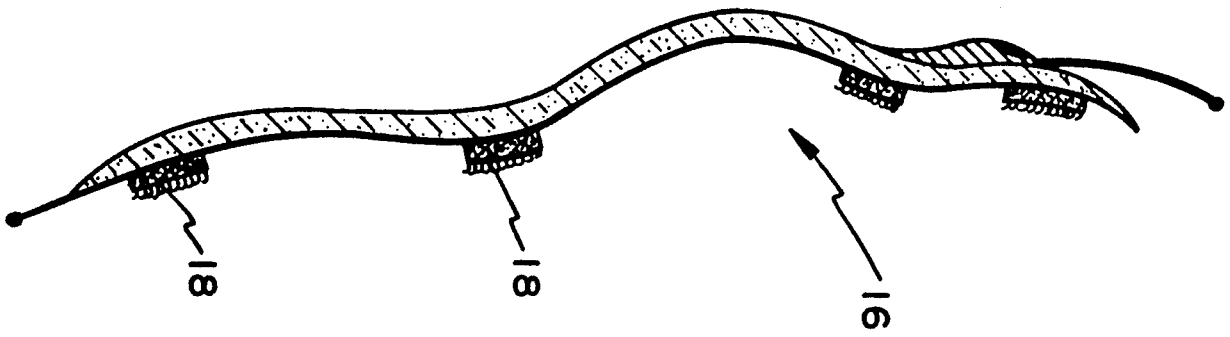
FIG. 3 is a side view of the nylon stocking patch of FIG. 2.

Referring now to FIG. 2, a patch 16 constructed in accordance with the principles of the present invention and shaped as a butterfly is shown-by way of illustration and not limitation. The patches 16 may be available in a variety of sizes to accommodate various degrees of tears. VELCRO TM pieces 18 are placed in different locations to insure a secure attachment. FIG. 3 illustrates a side view of the patch 16, partially in cross section.

Figure 4:
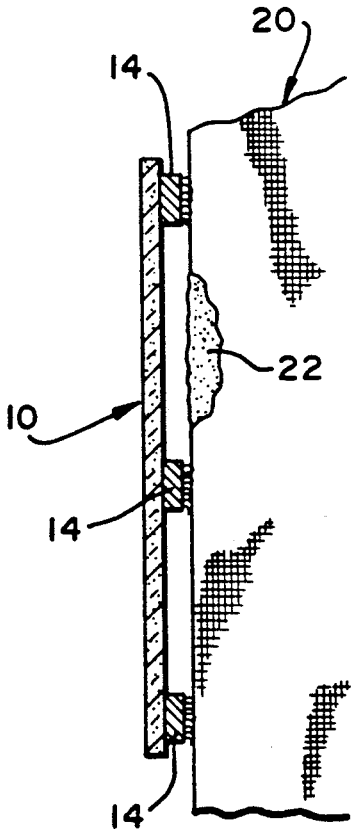
FIG. 4 is a side view a nylon stocking patch, shown attached to a damaged nylon stocking.

Referring now to FIG. 4, a patch 10 is shown attached to a portion of a nylon stocking 20. The patch 10 is preferably positioned so that VELCRO TM pieces 14 are on opposite sides of a tear 22.

The patches 10, due to their simple design, small size and flexibility may be easily stored in any size purse or, for example, an appropriate small storage box, before and after actual use. Furthermore, they are reusable whenever a temporary repair of nylon stockings is required.

The variety of shapes and sizes is endless. For example, the patches 10 may come as comic figures, animal figures, plant figures, etc.

Obviously, many modifications and variations of the present invention are possible in light of the above teachings. It is therefore to be understood that, within the scope of the appended claims, the invention may be practiced otherwise than as specifically described. For example, instead of polyamide, the resilient material may be formed of thin plastic, thin metal, or cellulose.

What is claimed and desired to be secured by Letters Patent of the United States is:

1. A self-adhesive stocking patch for mending a nylon stocking, comprising:

a) a thin resilient element of a shape and size to approximate typical tears occurring in nylon stockings; and, b) adhesive attachment means affixed to said element for securely attaching said element to portions of said nylon stocking adjacent to such a tear, said adhesive attachment means including at least one piece of synthetic material having a plurality of slender, hooked filaments so arranged and constructed to efficiently attach to said nylon stocking, the attachment of said element to said stocking thereby patching said tear.

2. The self-adhesive stocking patch of claim 1 wherein said resilient element is formed of polyamide.

3. The self-adhesive stocking patch of claim 1 wherein said adhesive attachement means includes a plurality of said pieces of synthetic material.

* * * * *